United States Patent [19]

Van Benthuysen

[11] 4,035,759

[45] July 12, 1977

[54] ELECTRICAL CONTROL HAVING AN INSULATED SHAFT EXTENSION

[75] Inventor: John D. Van Benthuysen, Elkhart, Ind.

[73] Assignee: CTS Corporation, Elkhart, Ind.

[21] Appl. No.: 606,461

[22] Filed: Aug. 21, 1975

Related U.S. Application Data

[60] Division of Ser. No. 342,862, March 19, 1973, Pat. No. 3,902,152, which is a continuation-in-part of Ser. No. 859,074, Sept. 18, 1969, abandoned.

[51] Int. Cl.[2] ..... H01C 10/32

[52] U.S. Cl. ..... 338/162; 200/331; 338/163

[58] Field of Search ..... 338/160, 162, 163, 166, 338/190; 174/153 R; 200/330, 331, 336, 340

[56] References Cited

U.S. PATENT DOCUMENTS

| | | | |
|---|---|---|---|
| 2,781,436 | 2/1957 | Barden | 338/162 X |
| 3,427,680 | 2/1969 | Gilbert | 338/162 X |
| 3,594,529 | 7/1971 | Cartwright | 200/330 |

*Primary Examiner*—C. L. Albritton
*Attorney, Agent, or Firm*—John J. Gaydos

[57] ABSTRACT

An electrical control is provided with an insulated shaft extension. The insulated shaft extension is attached to a metal shaft rotatably supported in a bushing attached to the housing of the control. A hollow shaft portion of the insulated shaft extension is in concentric relationship with the metal shaft. Tabs are sheared from the hollow shaft portion to abut against a shoulder defined by a reduced diameter portion on the metal shaft. The metal shaft has a flat which mates with a flat formed in the hollow shaft portion to prevent relative rotation of the shafts. Deformable ribs extend along the flat in the hollow shaft portion to ensure engagement with the flat on the metal shaft.

4 Claims, 7 Drawing Figures

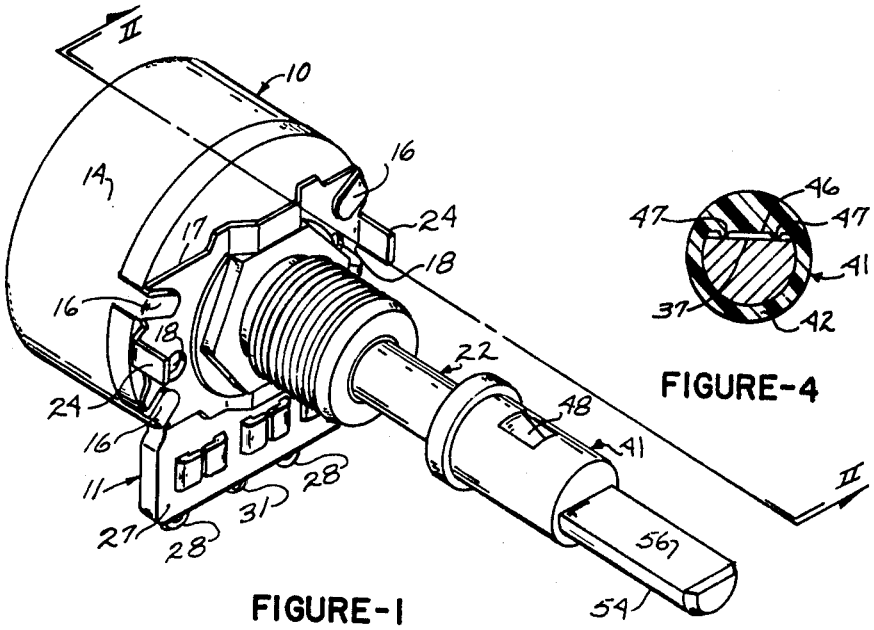
FIGURE-1
FIGURE-4
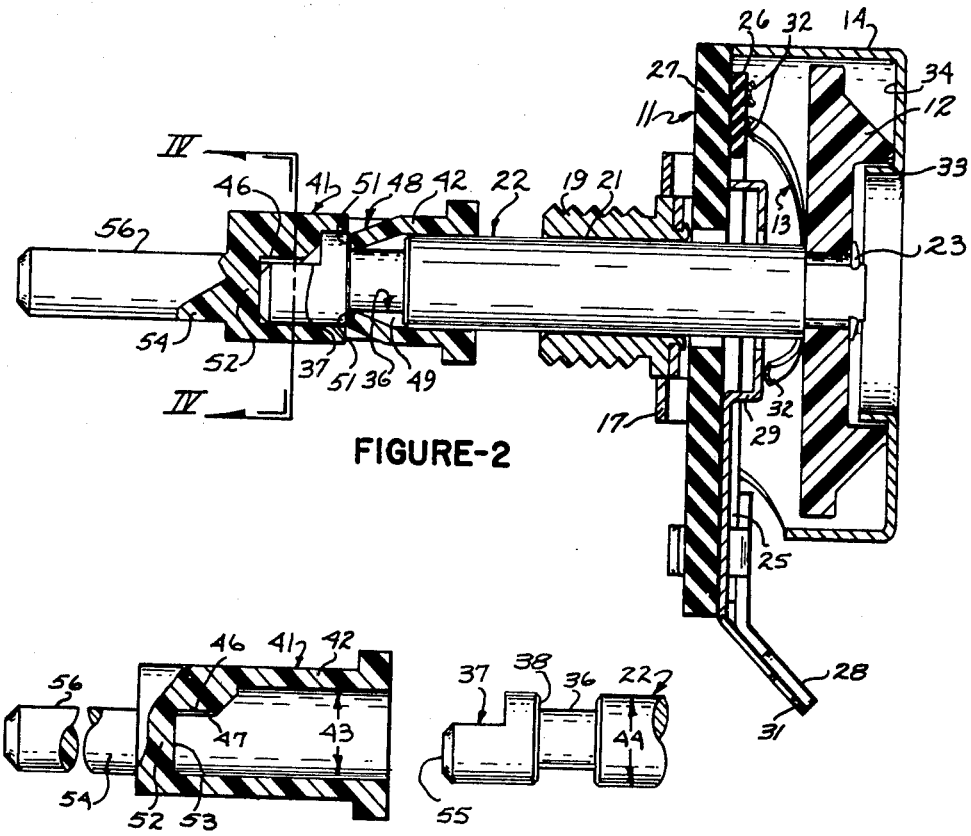
FIGURE-2
FIGURE-3

ELECTRICAL CONTROL HAVING AN INSULATED SHAFT EXTENSION

This is a division of application Ser. No. 342,862 filed Mar. 19, 1973 issuing as U.S. Pat. No. 3,902,152 on Aug. 26, 1975, which is a continuation-in-part of application Ser. No. 859,074 filed on Sept. 18, 1969 now abandoned.

The present invention relates to electrical controls and, more particularly, to an electrical control, such as a variable resistor or an electric switch, having an insulated shaft and to a method of making the same.

In electrical controls it is desirable to insulate the actuating shaft to reduce the possibility of electrical shock to the user. In the past such insulation has taken the form of a solid molded plastic shaft or a hollow molded plastic shaft glued to a metal shaft. These constructions have not, however, provided a satisfactory solution to the problem. A problem associated with a solid molded plastic shaft is the inability to obtain close tolerances between the molded plastic shaft and the bearing in the housing of the control which rotatably supports the shaft. A loose bearing fit is undesirable in that the shaft will wobble making it difficult to obtain and maintain the desired setting of the control. Also, in wobbling, objectionable noise is created. The inability to obtain close tolerances is primarily due to the shrinkage of the plastic during the molding of the shaft. This can be partially corrected by designing a mold larger than the desired shaft, however, a problem arises here in that if the shaft is slightly larger than the bearing it will bind making it extremely difficult to set the control. Due to the many factors which contribute to shrinkage it is difficult to design a mold to consistently achieve a desired diameter under a wide range of operating conditions. Therefore, it is desirable to have a machined metal shaft rotatably supported by the bearing as closer tolerances can be obtained thereby resulting in increased accuracy of the control. Such a shaft has been insulated by gluing a molded plastic boot to the metal shaft. This is undesirable in that the gluing process is a hand process necessitating much labor time and resulting in high labor costs. Another problem associated with the gluing of the molded plastic boot onto the metal shaft is its poor pull-out strength. In molding the plastic boot to form a hollow shaft portion which fits over the metal shaft, the plastic is molded around a mandrel. Since the boot must be removed from the mandrel it is necessary that there are neither projections nor recesses on the mandrel. Therefore there are neither projections nor recesses on the interior of the hollow molded boot around which or into which glue could flow to provide a bond having good pull-out strength. Poor pull-out strength results in the molded boot being pulled off the metal shaft and exposing the metal shaft, thereby increasing the possibility of shock to the user. It would, therefore, be desirable to provide an electrical control with an insulated shaft wherein the above problems have been obviated.

Certain prior art insulated shaft extensions are shown, for example, in Kenyon U.S. Pat. No. 3,429,199 wherein the insulated shaft extension or connector for a switch is frictionally secured to the end of a plastic shaft after the proper length has been determined usually by a repairman during installation of the switch. Inadvertent detachment of the shaft extension from the main shaft of the switch of Kenyon would not increase the possibility of electrical shock to the user since the main shaft of Kenyon is made of an electrically nonconductive material such as plastic and the shaft extension is designed for removal. Such shaft extension, however, is not provided with any means other than frictional means for interlocking the extension to the main shaft to prevent removal thereof. It would be desirable to provide an insulated shaft extension of an electrical control with a mechanical interlock fixedly securing the shaft extension directly to a metal shaft to prevent inadvertent removal of the shaft extension and further eliminate the possibility of electrical shock to the user.

In other prior art patents such as shown in Cole U.S. Pat. No. 2,496,700, an insulating knob is rotatably secured to an arm of a crank. Although such knob securement functions satisfactorily for window cranks and the like, such knob securement is not intended and would not be adequate for controls having shafts requiring axial rotation. Moreover, Cole requires that a separate metal insert rotatable on the arm be provided with prongs for securing the insulated knob to the arm. It would, therefore, be desirable to provide an insulated shaft extension with means for directly securing the shaft extension to an axially rotatable metal shaft to prevent relative rotation therebetween.

Accordingly, it is an object of the present invention to provide an electrical control with a new and improved insulated shaft. Another object of the present invention is to provide an electrical control with an insulated shaft maintaining close tolerances with the bearing supporting the shaft in the housing of the control. A further object of the present invention is to provide a molded insulated shaft extension which eliminates the fabrication step of gluing. An additional object of the present invention is to provide an insulated shaft extension having good pull-out strength from the metal shaft. Yet another object of the present invention is to provide an insulated shaft extension which, if it fails, will fail without exposing the metal shaft. Yet a further object of the present invention is to eliminate the possibility of relative rotation between a molded insulated shaft extension and a metal shaft. Yet an additional object of the present invention is to provide a method of assembling an insulated shaft extension to a metal shaft in a simple and facile manner. Still another object of the present invention is to provide a method of assemblying an insulated shaft extension to a metal shaft by a mechanical high speed operation. Further objects and advantages of the present invention will become apparent as the following description proceeds and the features of novelty characterizing the invention will be pointed out with particularity in the claims annexed to and forming a part of this specification.

Briefly, the present invention is concerned with an electrical control such as a variable resistance control having a driver actuator or an electrical switch having a switch actuator operable with an insulated shaft. An insulated driver is supported on one end of a metal shaft rotatably supported in a hollow bore of a bushing attached to the housing of the control. An insulated shaft extension is attached to the other end of the shaft. The insulated shaft extension has a hollow shaft portion in concentric relationship with the metal shaft. A reduced diameter portion on the metal shaft defines a shoulder. Tabs are sheared from the hollow shaft portion into the space above the reduced diameter portion to abut against the shoulder thereby securing the extension to the metal shaft. The metal shaft has a flat which mates with a flat formed in the hollow shaft portion of the extension thereby preventing relative rotation between the metal shaft and insulated extension. Deformable ribs extend along the flat in the hollow shaft portion to ensure engagement with the flat on the metal shaft.

For a better understanding of the present invention reference may be had to the accompanying drawings wherein the same reference numerals have been applied to like parts and wherein:

FIG. 1 is an isometric view of an improved electrical control built in accord with the present invention;

FIG. 2 is a sectional view taken along line II—II of FIG. 1;

FIG. 3 is a fragmentary exploded view, partly sectional, of the control built in accord with the present invention prior to assembly;

FIG. 4 is a sectional view taken along line IV—IV of FIG. 2; and

Figure 5:
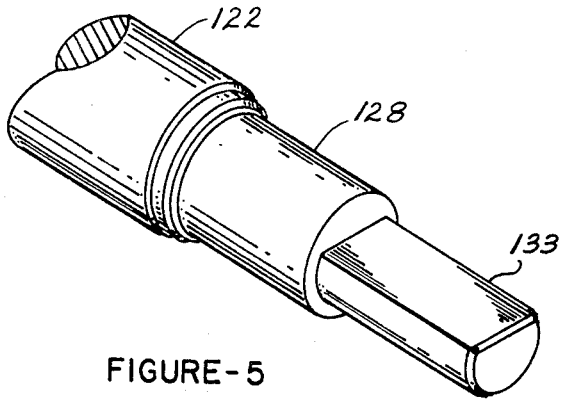
FIGS. 5, 6 and 7 are views of another embodiment of the invention.

Referring now to the drawings there is illustrated an electrical control generally indicated at 10 comprising a base assembly 11, a driver actuator 12 of insulating material, a contactor 13, and a cup-shaped cover 14 provided with a plurality of ears 16 folded over the base assembly 11 to secure the cover 14 to the base assembly 11.

For the purpose of mounting the control to a not-shown panel or the like, a mounting plate 17 having a pair of protuberances 18 alignable with a pair of cavities, not-shown, in the base assembly 11 is secured to the base assembly 11 by ears 16. Extending forwardly of the mounting plate 17 and fixedly secured thereto is an externally inserted bushing 19 provided with a hollow bore 21 rotatably supporting a metal shaft 22 staked to the driver actuator 12 at 23. A suitable not-shown fastner threadably engageable with the bushing secures the control 10 to the panel. To orient the control 10 on the panel, the mounting plate 17 is provided with upwardly extending legs 24 insertable into slots provided in the panel. An arcuate resistance element 26 is suitably attached to a base 27 and the ends 25 of the resistance element 26 are connected to a pair of terminals 28 suitably secured to the base. A center collector 29 in fixed relationship with respect to the resistance element 26 is provided with a center terminal 31. The contactor 13 wipably engages the center collector 29 and the resistance element 26 thereby electrically connecting the resistance element 26 to the center collector 29. Resilient contact fingers 32 of the contactor 13 bias a thrust bearing 33 extending rearwardly of the driver actuator 12 against the inner rear wall 34 of the cover 14. The contactor 13 is secured to the driver actuator 12 and constrained to rotate with the driver actuator 12.

The metal shaft 22 staked to the insulated driver at 23 is provided with a reduced diameter portion 36 and a flat 37. The reduced diameter portion 36 forms an inwardly facing shoulder 38. A molded shaft extension 41 of suitable insulating material, such as nylon, has a hollow shaft portion 42 with an internal diameter 43 corresponding to the diameter 44 of the metal shaft 22. A flat 46 provided with the hollow shaft portion 42 of the shaft extension 41 mates with the flat 37 on the metal shaft 22 to prevent relative rotation of the shafts 22, 41 when assembled. Deformable ribs 47 extend from the flat 46 to ensure engagement with the flat 37 on the metal shaft 22. The ribs 47 are tapered slightly to facilitate removal of the molded shaft from a mandrel after molding and to facilitate entrance of the flat 37 during assembly. This permits the flat 46 to be molded slightly smaller than required to mate with flat 37 thus eliminating any problem with binding when assembling the two shafts 22, 41. The resilient ribs 47 deform slightly upon insertion of the flat 37 into the hollow shaft portion 42. In assembling the molded shaft extension 41 to the metal shaft 22 the extension is placed over the shaft and a shear punch deforms tabs 48 into a space 49 above the reduced diameter portion 36. The flat 56 has the same orientation as flat 46 such that alignment of flat 56 and flat 37 will properly align flat 37 for insertion into hollow shaft portion 42. This assembly is particularly adaptable to a high speed mechanized operation in that the angular orientation of the shaft relative to the shear punch is not critical since the tabs 48 can be sheared at any point around the whole circumference of the reduced diameter portion 36. Such a structural relationship eliminates the need for exact positioning of the shaft relative to the shear punch. The tabs 48 are sheared such that the free ends 51 of the tabs 48 abut against the inwardly facing shoulder 38 of the metal shaft 22, forming a strong mechanical lock, thereby retaining the molded shaft extension 41 on the metal shaft 22. A cap 52 of insulating material covers the end 53 of the hollow shaft portion 42 and a solid shaft 54 of insulating material extends therefrom. The end 53 of the hollow shaft portion 42 abuts against end 55 of the metal shaft to secure the hollow shaft portion 42 against movement due to push-in force on the shaft extension 41. To rotate the shafts 22, 41 and attached driver 12, a suitable, not-shown, knob is attached to a flat 56 on the solid shaft 54. The solid shaft 54 extending from the cap 52 has a smaller diameter than the hollow portion 42 and cap 52. Since the weakest point of the molded shaft extension occurs at the point of juncture of the shaft 54 and the cap 52, if the extension should fail, it will break at the above mentioned point leaving sufficient insulating material in the cap 52 to cover the end of the metal shaft 22 and eliminate possible shock to the user.

Figure 6:
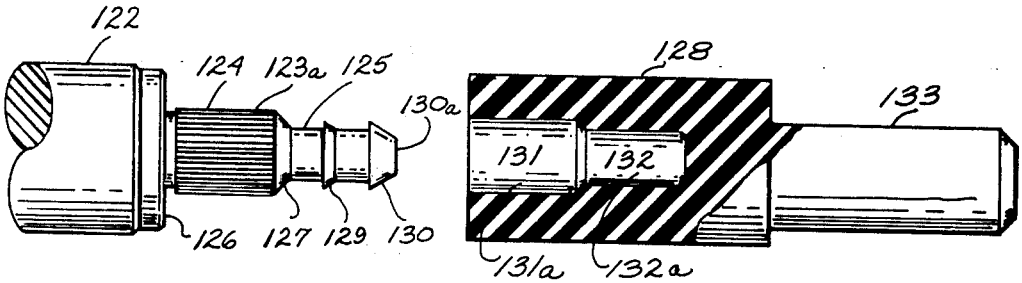
Figure 7:
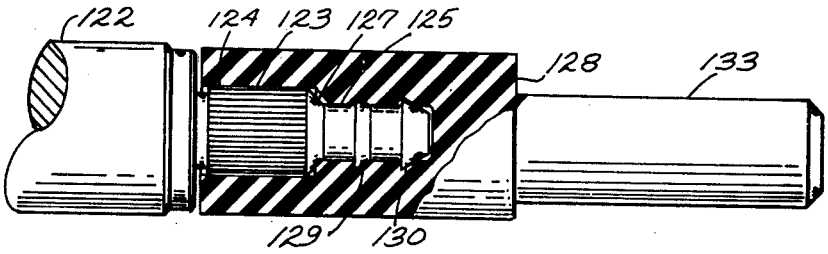

Another embodiment of the invention is shown in FIGS. 5 through 7 of the drawings. The metal shaft 122 extends from a driver in the same manner that the shaft 22 extends from the driver 12 as shown in FIG. 2 of the drawings. The end portion 123 of the metal shaft 122 is provided with a double diameter reduction, that is, a first reduced metal diameter portion 124 and a second reduced metal diameter portion 125 having a diameter smaller than the diameter of the portion 124. A shoulder 126 is provided between the end portion 123 and the metal shaft 122 while a chamber 127 is provided between the first and second metal diameter portions 124 and 125. For the purpose of preventing removal of an insulated shaft extension 128 from the shaft 122, a pair of peripheral lips 129 and 130 project radially outwardly from the second reduced metal diameter portion 125. In a preferred form of the invention, the peripheral lips are defined by acute angles thereby providing sharp corners and assuring that each of the lips bites into and anchors the shaft 122 to the insulated shaft extension 128. By making the corners of the peripheral lips with an acute angle, extreme difficulty is also encountered in disassemblying the insulated shaft extension 128 from the metal shaft 122. The outer peripheral lip 130 continues beyond the end of the second reduced diameter portion 125 and terminates with tapered head portion 130*a* having a diameter less than the portion 125 to assure assembly of the insulated shaft extension 128 to the metal shaft 122 in a simple and facile manner. As shown in FIG. 7, the outer diameter of the insulated shaft extension 128 is substantially the same as the diameter of the shaft 122.

The insulated shaft extension 128 is provided with a front hollow portion 131 communicating with the front of the insulated shaft extension and a rear hollow portion 132 having a diameter less than the diameter of the front hollow portion 131. In assembly, the shaft extension 128 is telescopically forced over the tapered head portion 130*a* until the peripheral lips 129, 130 extending radially outwardly from the second reduced diameter portion 125 bite into the rear wall 132*a* of the rear hollow portion 132. The first reduced metal diameter portion 124 also frictionally engages the inner wall 131*a* of the front hollow portion of the insulated shaft extension. Preferably the portion 124 is provided with antirotational means, e.g., a knurl, for preventing relative rotation between the shaft 122 and the shaft extension. After the insulated shaft extension 128 is secured to the metal shaft 122, twisting and turning of the reduced end portion 133 of the insulated shaft extension 128 of the present invention does not cause a fracture exposing the metal shaft portion to the user. Nylon and other suitable plastic materials can be employed for making the insulated shaft extension 128 of the present invention.

According to devices built in accord with the present invention, the insulated shaft extension was provided with an rear hollow portion 132 having a diameter of 0.098 inch and with a front hollow portion 131 having a diameter of 0.108 inch while the diameter of the peripheral lip was 0.105 inch, the second reduced metal diameter portion 125 was 0.090 inch and the diameter of the first reduced metal diameter portion 124 was 0.123 inch over the knurl.

While there has been illustrated and described what is at present considered to be a preferred embodiment of the present invention, it will be appreciated that numerous changes and modifications are likely to occur to those skilled in the art, and it is intended to cover all those changes and modifications which fall within the true spirit and scope of the present invention.

What is claimed as new and desired to be secured by Letters Patent of the United States is:

1. An electrical control comprising a base, a resistance path secured to the base, a driver of insulating material, a contactor constrained to move with the driver for making wiping contact with the resistance path, a metal shaft extending from said driver, said metal shaft being provided with a first reduced diameter portion and a second reduced diameter portion, a first peripheral lip extending outwardly from the second reduced diameter portion and having a diameter greater than the diameter of the second reduced diameter portion, an insulated shaft extension of resilient plastic material telescopically secured to the first and second reduced diameter portions, said insulated shaft extension comprising a first hollow portion having a diameter slightly smaller than the first reduced diameter portion and a second hollow portion inwardly of and communicating with the first hollow portion and having a diameter less than the diameter of the first hollow portion, the diameter of the second hollow portion being less than the diameter of the peripheral lip, said peripheral lip biting directly into the wall of the second hollow portion thereby maintaining the insulated shaft extension mechanically anchored to said metal shaft.

2. The control of claim 1, wherein means on said first reduced diameter portion prevents rotation between the metal shaft and the shaft extension.

3. The control of claim 1, wherein a second peripheral lip is provided on the second reduced diameter portion and is axially spaced from the first peripheral lip thereby further anchoring the insulated shaft extension to the metal shaft.

4. The control of claim 1, wherein the peripheral lip has a diameter less than the diameter of the first reduced diameter portion.

* * * * *